US009245673B2

(12) United States Patent
Carroll et al.

(10) Patent No.: US 9,245,673 B2
(45) Date of Patent: Jan. 26, 2016

(54) PERFORMANCE IMPROVEMENT OF MAGNETOCALORIC CASCADES THROUGH OPTIMIZED MATERIAL ARRANGEMENT

(71) Applicant: BASF SE, Ludwigshafen (DE)

(72) Inventors: Colman Carroll, Mannheim (DE); Olaf Rogge, Waghaeusel (DE); Bernard Hendrik Reesink, Winterswijk-Kotten (NL); Andrew Rowe, Victoria (CA); Danny Arnold, Victoria (CA); Armando Tura, Victoria (CA)

(73) Assignee: BASF SE, Ludwigshafen (DE)

( * ) Notice: Subject to any disclaimer, the term of this patent is extended or adjusted under 35 U.S.C. 154(b) by 179 days.

(21) Appl. No.: 14/162,123

(22) Filed: Jan. 23, 2014

(65) Prior Publication Data

US 2014/0202171 A1 Jul. 24, 2014

Related U.S. Application Data

(60) Provisional application No. 61/755,999, filed on Jan. 24, 2013.

(51) Int. Cl.
*H01F 1/01* (2006.01)

(52) U.S. Cl.
CPC ..... *H01F 1/015* (2013.01)

(58) Field of Classification Search
CPC ..... H01F 1/017; H01F 1/015; F25B 21/00; F25B 2321/002; Y10T 29/4935; Y02B 30/66
USPC ..... 62/3.1, 3.3, 335, 238.1, 324.2; 165/135, 165/185; 252/62.51 R, 62.55
See application file for complete search history.

(56) References Cited

U.S. PATENT DOCUMENTS 5,435,137 A * 7/1995 Gschneidner, Jr. ..... H01F 1/015 148/301
5,743,095 A * 4/1998 Gschneidner, Jr. ..... F25B 21/00 148/301

(Continued)

FOREIGN PATENT DOCUMENTS

CN 101105996 A 1/2008
WO WO 97/25292 A1 7/1997

(Continued)

OTHER PUBLICATIONS

International Search Report issued May 8, 2014, in PCT/IB2014/058251, filed Jan. 14, 2014.

*Primary Examiner* — Mohammad M Ali
(74) *Attorney, Agent, or Firm* — Oblon, McClelland, Maier & Neustadt, L.L.P.

(57) ABSTRACT

A magnetocaloric cascade containing at least three different magnetocaloric materials with different Curie temperatures, which are arranged in succession by descending Curie temperature, wherein none of the different magnetocaloric materials with different Curie temperatures has a higher layer performance Lp than the magnetocaloric material with the highest Curie temperature and wherein at least one of the different magnetocaloric materials with different Curie temperatures has as lower layer performance Lp than the magnetocaloric material with the highest Curie temperature wherein Lp of a particular magnetocaloric material being calculated according to formula (I):

$$Lp=m*dT_{ad,max}$$

with $dT_{ad,max}$: maximum adiabatic temperature change which the particular magnetocaloric material undergoes when it is magnetized from a low magnetic field to high magnetic field during magnetocaloric cycling, m: mass of the particular magnetocaloric material contained in the magnetocaloric cascade.

14 Claims, 5 Drawing Sheets

(56) References Cited

U.S. PATENT DOCUMENTS

| | | | | |
|---|---|---|---|---|
| 7,114,340 | B2 * | 10/2006 | Pecharsky | C22C 28/00 148/101 |
| 7,481,064 | B2 * | 1/2009 | Kitanovski | F25B 21/00 62/3.1 |
| 7,833,361 | B2 * | 11/2010 | Saito | B22F 9/10 148/301 |
| 7,993,542 | B2 * | 8/2011 | Sakurada | C22C 38/005 148/300 |
| 8,104,293 | B2 | 1/2012 | Barve et al. | |
| 2003/0221750 | A1 * | 12/2003 | Pecharsky | C22C 28/00 148/121 |
| 2004/0031514 | A1 * | 2/2004 | Bell | B60H 1/2215 136/203 |
| 2004/0093877 | A1 | 5/2004 | Wada et al. | |
| 2009/0217674 | A1 * | 9/2009 | Kaji | F25B 21/00 62/3.1 |
| 2011/0049413 | A1 * | 3/2011 | Mazet | H01F 1/015 252/67 |
| 2011/0094243 | A1 | 4/2011 | Carroll et al. | |
| 2011/0173993 | A1 | 7/2011 | Muller et al. | |
| 2012/0043497 | A1 * | 2/2012 | Katter | H01F 1/015 252/67 |

FOREIGN PATENT DOCUMENTS

| | | | |
|---|---|---|---|
| WO | WO 03/012801 | A1 | 2/2003 |
| WO | WO 2004/068512 | A1 | 8/2004 |
| WO | WO 2010/121977 | A1 | 10/2010 |
| WO | WO 2011/018314 | A1 | 2/2011 |
| WO | WO 2011/083446 | A1 | 7/2011 |
| WO | WO 2011/111004 | A1 | 9/2011 |

* cited by examiner

PERFORMANCE IMPROVEMENT OF MAGNETOCALORIC CASCADES THROUGH OPTIMIZED MATERIAL ARRANGEMENT

The invention relates to a magnetocaloric cascade containing at least three different magnetocaloric materials with different Curie temperatures, which are arranged in succession by descending Curie temperature, wherein the magnetocaloric materials with higher Curie temperatures are weighted more than the magnetocaloric material with lower Curie temperatures, to a process for production thereof, to the use thereof in refrigeration systems, climate control units, and heat pumps and to the refrigeration systems, climate control units, and heat pumps comprising the inventive magnetocaloric cascades.

Magnetocaloric materials are known in principle and are described, for example, in WO 2004/068512 A1. Such materials can be used in magnetic cooling techniques based on the magnetocaloric effect (MCE) and may constitute an alternative to the known vapor circulation cooling methods. In a material which exhibits a magnetocaloric effect, the alignment of randomly aligned magnetic moments by an external magnetic field leads to heating of the material. This heat can be removed from the magnetocaloric material to the surrounding atmosphere by a heat transfer. When the magnetic field is then switched off or removed, the magnetic moments revert back to a random arrangement, which leads to cooling of the material below ambient temperature. This effect can be exploited in heat pumps or for cooling purposes; see also Nature, Vol. 415, Jan. 10, 2002, pages 150 to 152. Typically, a heat transfer medium such as water is used for heat removal from the magnetocaloric material.

US 2004/0093877 A1 discloses a magnetocaloric material showing a sufficient large magnetocaloric effect at or near room temperature and a magnetic refrigerator using such magnetocaloric material. The composition of the magnetocaloric material may be varied yielding magnetocaloric materials exhibiting different Curie temperatures, i.e. different temperatures of the magnetic phase transition. The magnetocaloric materials are arranged in a first and a second regenerator bed which are exposed to varying magnetic fields. The regenerators form the core of a magnetic refrigerator.

U.S. Pat. No. 8,104,293 B2 relates to a magnetocaloric cooling device comprising a plurality of thermally coupled magnetocaloric elements, one or more reservoirs containing a fluid medium and two heat exchangers. The heat exchangers are thermally coupled to the magnetocaloric elements and to at least one of the reservoirs for transferring heat between the magnetocaloric elements and the environment through the fluid medium.

WO 2011/018314 A1 describes a heat exchanger bed made of a cascade of magnetocaloric materials with different Curie temperatures arranged in succession by descending or ascending Curie temperature wherein the maximum difference in the Curie temperatures between two adjacent magnetocaloric materials is of 0.5 to 6 K. This allows a large temperature change overall to be achieved in a single heat exchanger bed.

US 2011/0173993 A1 refers to a magnetocaloric element comprising an alignment of at least two adjacent sets of magnetocaloric materials having different Curie temperatures being arranged according to an increasing Curie temperature wherein the magnetocaloric materials within a same set have a same Curie temperature. The magnetocaloric element further comprises initiating means for initiating a temperature gradient between two opposite hot and cold ends of the magnetocaloric element.

Figure 1:
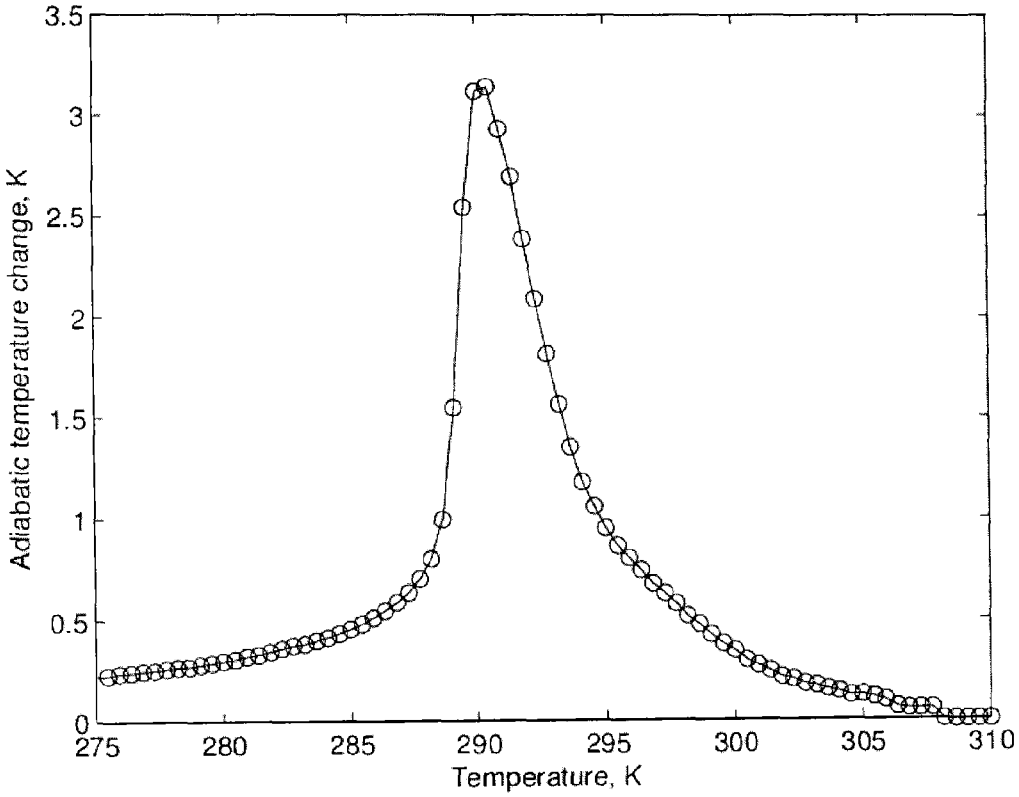
FIG. 1 shows a graph of an adiabatic temperature change of a magnetocaloric material and a temperature of the megnetocaloric material when the magnetocaloric material is cycled between the low and high magnetic fields.

Despite the efforts to improve devices exploiting the magnetocaloric effect made so far the need for further enhancement of the efficiency and applicability of devices exploiting the magnetocaloric effect still exists, in particular the improvement of the efficiency and applicability of devices for cooling or heat pumping. Therefore, it is an object of the present invention to improve the efficiency and applicability of devices exploiting the magnetocaloric effect, in particular of such devices for cooling purposes or heat pumping.

This object is achieved by a magnetocaloric cascade containing at least three different magnetocaloric materials with different Curie temperatures, which are arranged in succession by descending Curie temperature, wherein none of the different magnetocaloric materials with different Curie temperatures has a higher layer performance Lp than the magnetocaloric material with the highest Curie temperature and wherein at least one of the different magnetocaloric materials with different Curie temperatures has as lower layer performance Lp than the magnetocaloric material with the highest Curie temperature wherein Lp of a particular magnetocaloric material being calculated according to formula (I):

$$Lp=m*dT_{ad,max}$$

with $dT_{ad,max}$: maximum adiabatic temperature change which the particular material undergoes when it is magnetized from a low magnetic field to high magnetic field during magnetocaloric cycling, m: mass of the particular magnetocaloric material contained in the magnetocaloric cascade.

The object is also achieved by a process for producing such magnetocaloric cascades, the use of such magnetocaloric cascades in refrigeration systems, climate control units, and heat pumps and by the refrigeration systems, climate control units, and heat pumps comprising such magnetocaloric cascades.

In comparison with magnetocaloric cascades containing different magnetocaloric materials with different Curie temperatures, which are arranged in succession by descending Curie temperature but without the inventive stronger weighting of the magnetocaloric materials with higher Curie temperature, the inventive magnetocaloric cascades show broader temperature spans between the hot and the cold side of the magnetocaloric cascades and higher cooling power.

An inventive magnetocaloric cascade contains different magnetocaloric materials. The different magnetocaloric materials have different Curie temperatures. The Curie temperature of a magnetocaloric material is the temperature at which the magnetic phase transition of the magnetocaloric material occurs. The Curie temperature can be measured by DSC at zero magnetic field and is the temperature at which the specific heat capacity is at its maximum value in the region of the magnetic phase transition. For many magnetocaloric materials the magnetic phase transition occurs between the ferromagnetic state and the paramagnetic state. The different magnetocaloric materials having different Curie temperatures can be obtained from a magnetocaloric material of a certain composition by varying individual constituents or the amounts of individual constituents as described for example in WO 2004/068512 A1 and WO 2003/012801. It is also possible to combine completely different magnetocaloric materials with one another, provided that the inventive sequence of the Curie temperatures is maintained.

The inventive magnetocaloric cascade contains at least three different magnetocaloric materials with different Curie temperatures. The number of magnetocaloric materials can be guided by the practical requirements and apparatus features. A relatively large number of different magnetocaloric materials can exploit a relatively wide temperature range. Preferably the inventive magnetocaloric cascade contains 3 to 100, more preferred 5 to 100 and even more preferred 10 to 100 different magnetocaloric materials with different Curie temperatures.

The different magnetocaloric materials with different Curie temperatures are arranged in succession by descending Curie temperature, i.e. the magnetocaloric material having the highest Curie temperature is arranged at one end of the cascade, the magnetocaloric material having the second highest Curie temperature is placed adjacently and so on, the magnetocaloric material having the lowest Curie temperature is placed at the opposite end of the cascade. The end of the cascade where the magnetocaloric material with the highest Curie temperature is located corresponds to the hot side of the magnetocaloric cascade, the end of the cascade where the magnetocaloric material with the lowest Curie temperature is located, corresponds to the cold side of the magnetocaloric cascade. It is preferred if the difference in the Curie temperatures of two adjacent magnetocaloric materials with different Curie temperatures is 0.5 to 6 K, more preferred 0.5 to 4 K and in particular preferred 0.5 to 2.5 K.

The total difference in the Curie temperatures between the material with the highest Curie temperature and the material with the lowest Curie temperature is preferably 3 to 80 K, more preferably 8 to 80 K. For example, in a combination of five different materials with a Curie temperature difference of 2 K between any two adjacent materials in the cascade, a temperature range of 8 K may arise. Use of a plurality of materials with different Curie temperatures makes it possible to achieve a significantly greater temperature range than is possible using a single magnetocaloric material.

Magnetocaloric materials may show a thermal hysteresis at the magnetic phase transition. According to the invention, magnetocaloric materials are preferably used which have a low thermal hysteresis, e.g. of less than 5 K, more preferably of less than 3 K, especially preferred of less than 2 K.

In the inventive magnetocaloric cascade the magnetocaloric materials with higher Curie temperature are weighted stronger, i.e. the different magnetocaloric materials with different Curie temperatures contained in the magnetocaloric cascade are selected such that none of the different magnetocaloric materials with different Curie temperatures has a higher layer performance Lp than the magnetocaloric material with the highest Curie temperature and that at least one of the different magnetocaloric materials with different Curie temperatures has as lower layer performance Lp than the magnetocaloric material with the highest Curie temperature. The layer performance Lp of a particular magnetocaloric material contained in the inventive magnetocaloric cascade is calculated according to formula (I):

$$Lp=m*dT_{ad,max}$$

with $dT_{ad,max}$: maximum adiabatic temperature change which the particular magnetocaloric material undergoes when it is magnetized from a low magnetic field to high magnetic field during magnetocaloric cycling, m: mass of the particular magnetocaloric material contained in the magnetocaloric cascade.

In magnetocaloric cycles, the magnetocaloric material is cycled between low and high magnetic fields. Low magnetic fields are typically 0 to 0.3 T; high magnetic fields are typically 0.6 to 5 T, preferred 0.6 to 2 T. In order to measure the adiabatic change of temperature $dT_{ad}$ of a magnetocaloric material during magnetization, a sample of the magnetocaloric material is repeatedly cycled between the desired low and high fields, e.g. between 0 and 1 T. This can be done, for example, by physically moving the sample into and out of a magnetic field. During this cycling, the temperature of the sample is measured, and the temperature change observed when the sample is introduced into and removed from the field is recorded. This process is repeated over a range of temperatures encompassing the Curie temperature (for example, by using a climate chamber), which allows the $dT_{ad}$ to be recorded as a function of temperature. $dT_{ad,max}$ is the value of $dT_{ad}$ at the temperature where $dT_{ad}$ is largest. Typical values of $dT_{ad,max\ are}$ 1 to 8 K for a magnetic field change from zero to 1 T. An example of the result of such measurement is given in FIG. 1 showing a $dT_{ad,max}$ of about 3.1 K. A description of such a measurement can be found in R. Bjork, C. Bahl, and M. Katter, Journal of Magnetism and Magnetic Materials 33, 3882 (2010).

Each magnetocaloric material present in the inventive magnetocaloric cascade contributes to the overall effect of the cascade. The parameter layer performance Lp of a particular magnetocaloric material is a kind of measure for the possible contribution of a particular magnetocaloric material present in the magnetocaloric cascade. It is influenced by the quality of the magnetocaloric material, i.e. how large or small is the magnetocaloric effect shown by the particular magnetocaloric material, and by the amount, i.e. the mass of the particular magnetocaloric material contained in the cascade. The value $dT_{ad,max}$ was chosen according to the invention to indicate the quality of the magnetocaloric materials. The larger $dT_{ad,max}$, the better the magnetocaloric quality of a material, i.e the larger is the magnetocaloric effect/magnetocaloric performance of that material. Two possible cases are described in the following to illustrate the effect of $dT_{ad,max}$ and the mass of the magnetocaloric material.

The first case relates to an inventive magnetocaloric cascade containing at least 3 different magnetocaloric materials with different Curie temperature arranged according to ascending Curie temperature, each of the different magnetocaloric materials of different Curie temperatures is present in the same amount, i.e. the mass of every magnetocaloric material with different Curie temperature is equal. The magnetocaloric material with the highest Curie temperature has the highest $dT_{ad,max}$, all other magnetocaloric materials of different Curie temperature have a lower $dT_{ad,max}$. Hence, the magnetocaloric material having the highest Curie temperature has the highest layer performance Lp of all magnetocaloric materials of different Curie temperature contained in the magnetocaloric cascade.

The second case relates to an inventive magnetocaloric cascade containing at least 3 different magnetocaloric materials with different Curie temperature arranged according to ascending Curie temperature, each magnetocaloric material has the same $dT_{ad,max}$. The mass of the magnetocaloric material with the highest Curie temperature is higher than the mass of each of the other different magnetocaloric materials contained in the cascade. Therefore the magnetocaloric material with the highest Curie temperature has the highest layer performance Lp.

As shown in the examples better results are obtained for magnetocaloric cascades containing different magnetocaloric materials with different Curie temperatures arranged in succession by descending Curie temperature wherein none of the different magnetocaloric materials with different Curie temperatures has a higher layer performance Lp than the magnetocaloric material with the highest Curie temperature but at least one of the different magnetocaloric materials with different Curie temperatures has as lower layer performance Lp than the magnetocaloric material with the highest Curie temperature. The best result of the examples is obtained for such a magnetocaloric cascade, wherein the layer performance Lp of each of the different magnetocaloric materials is equal or higher than the layer performance of its adjacent magnetocaloric material with lower Curie temperature.

In one embodiment of the inventive magnetocaloric cascade none of the different magnetocaloric materials with different Curie temperatures has a lower layer performance Lp than the magnetocaloric material with the lowest Curie temperature.

According to another embodiment of the inventive magnetocaloric cascade the layer performance Lp of the magnetocaloric material with the highest Curie temperature is 2 to 100%, preferably 5 to 60% and in particular 5 to 25% higher than the layer performance Lp of each of the other different magnetocaloric materials with different Curie temperature contained in the magnetocaloric cascade.

According to a further embodiment of the inventive magnetocaloric cascade the layer performance Lp of each of the different magnetocaloric materials with different Curie temperatures is equal or higher than the layer performance of its adjacent magnetocaloric material with lower Curie temperature, preferably the layer performance Lp of each of the different magnetocaloric materials with different Curie temperatures is higher than the layer performance of its adjacent magnetocaloric material with lower Curie temperature. If the layer performance Lp of a magnetocaloric material is higher than the layer performance of its adjacent magnetocaloric material with lower Curie temperature, it is preferred, that it is higher by 2 to 100%, more preferred by 5 to 60% and especially higher by 5 to 25%. It is most preferred if the layer performance Lp of each of the different magnetocaloric materials with different Curie temperatures is higher than the layer performance of its adjacent magnetocaloric material with lower Curie temperature by 2 to 100%, preferably by 5 to 60% and especially by 5 to 25%.

In another embodiment of the inventive magnetocaloric cascade the mass of each of the different magnetocaloric materials with different Curie temperatures contained in the magnetocaloric cascade is equal or higher than the mass of its adjacent magnetocaloric material with lower Curie temperature, preferred the mass of each magnetocaloric material contained in the magnetocaloric cascade is higher than the mass of the adjacent magnetocaloric material with lower Curie temperature. If the mass of a magnetocaloric material contained in the magnetocaloric cascade is higher than the mass of the adjacent magnetocaloric material with lower Curie temperature, it is preferably higher by 2 to 100%, more preferred higher by 5 to 60% and in particular by higher 5 to 25%. It is most preferred if the mass of each of the different magnetocaloric materials with different Curie temperatures is higher than the mass of its adjacent magnetocaloric material with lower Curie temperature by 2 to 100%, preferably by 5 to 60% and especially by 5 to 25%.

According to the invention, the different magnetocaloric materials are arranged in sequence in the magnetocaloric cascade. Adjacent magnetocaloric materials with different Curie temperatures may be in direct spatial contact with one another or they may have a separation of 0.01 to 1 mm, preferably a separation of 0.01 to 0.3 mm. The different magnetocaloric materials with different Curie temperatures may be insulated from one another by intermediate thermal and/or electrical insulators. In a preferred embodiment of the present invention adjacent magnetocaloric materials with different Curie temperatures are in direct spatial contact with one another.

An important feature for the performance of the magnetocaloric cascade is the heat transfer from and to the magnetocaloric cascade. The heat transfer is preferably performed by a heat transfer medium passing through the magnetocaloric cascade.

The three-dimensional form of the individual different magnetocaloric materials can be selected as desired. They may be packed beds of particles of the magnetocaloric materials. Alternatively, they may be stacked plates or shaped bodies which have continuous channels through which the heat exchange medium can flow. Suitable geometries are described below.

A packed bed composed of magnetocaloric material particles is a highly efficient material geometry which allows optimal operation of the magnetocaloric cascade. The individual material particles may have any desired form. The material particles are preferably in spherical form, pellet form, sheet form or cylinder form. The material particles are more preferably in spherical form. The diameter of the material particles, especially of the spheres, is 50 μm to 1 mm, more preferably 200 to 400 μm. The material particles, especially spheres, may have a size distribution. The porosity of the packed bed is preferably in the range from 30 to 45%, more preferably from 36 to 40%. The size distribution is preferably narrow, such that predominantly spheres of one size are present. The diameter preferably differs from the mean diameter by not more than 20%, more preferably by not more than 10%, especially by not more than 5%.

Material particles, especially spheres with the above dimensions, used as a packed bed in the inventive magnetocaloric cascades give high heat transfer coefficients between solid and a fluid used as heat exchanger fluid, the pressure drop being small to low. This allows an improved coefficient of performance (COP) of the packed bed. The high heat transfer coefficient allows the packed beds to be operated at higher frequencies than customary, and hence allows greater energy extraction.

For the particular operating conditions, the performance of the packed bed can be optimized by using material particles, especially spheres, of different diameter. A lower diameter, especially sphere diameter, leads to a higher coefficient of heat transfer and hence allows better heat exchange. This, however, is associated with a higher pressure drop through the packed bed. Conversely, the use of larger material particles, especially spheres, leads to slower heat transfer, but to lower pressure drops.

The packed bed composed of the magnetocaloric material particles can be produced in any suitable manner. The magnetocaloric material particles are first produced, for example by shaping a powder of the thermoelectric material to form the magnetocaloric material particles. Subsequently, the material particles are packed to form the packed bed. This can be done by pouring the material particles into a suitable vessel, in which case the settling of the bed can be improved by shaking. Floating in a fluid with subsequent settling of the material particles is also possible. It is additionally possible to settle the individual material particles in a controlled manner to form a homogeneous structure. In this case, it is possible, for example, to achieve a tight cubic packing of spheres.

The movement resistance of the packed bed of magnetocaloric material can be achieved by any suitable measures. For example, the vessel in which the packed bed of magnetocaloric material(s) is present can be closed on all sides. This can be done, for example, using a mesh cage. In addition, it is possible to join the individual material particles to one another, for example by surface melting of the material particles in the packed bed or by sintering the material particles to one another in the packed bed. The surface melting or sintering should be effected such that the interstices between the material particles are very substantially preserved.

The formation of the packed bed by magnetocaloric material particles in sheet, cylinder, pellet or sphere form or similar form is advantageous, since a large ratio of surface to mass is achieved therewith. This achieves an improved heat transfer rate coupled with relatively low pressure drop.

The magnetocaloric material can be present as shaped body, too. The shaped body may be a block of magnetocaloric material, in which case two opposite end sides of the block have entry and exit orifices for a fluid which are connected by continuous channels which run through the entire monolith. The continuous channels allow a liquid heat transfer medium to flow through, such as water, water/alcohol mixtures, water/salt mixtures or gases such as air or noble gases.

Preference is given to using water or water/alcohol mixtures, in which case the alcohol may be a mono- or polyhydric alcohol. For example, the alcohols may be glycols. Corresponding shaped bodies can be derived, for example, from a tube bundle in which the individual tubes of magnetocaloric material are joined to one another. The channels are preferably parallel to one another and generally run through the block of magnetocaloric material in a straight line. When particular use requirements are made, it is also possible to provide a curved profile of the channels. Corresponding block forms are known, for example, from automotive exhaust gas catalysts. The magnetocaloric material block may thus have, for example, a cellular form, in which case the individual cells may have any desired geometry. For example, the channels may have a hexagonal cross section as in the case of a honeycomb, or a rectangular cross section. Star-shaped cross sections, round cross sections, oval cross sections or other cross sections are also possible in accordance with the invention, provided that the following conditions are observed:

- cross-sectional area of the individual channels in the range from 0.001 to 0.2 $mm^2$, more preferably 0.01 to 0.03 $mm^2$, especially 0.015 to 0.025 $mm^2$
- wall thickness of 50 to 300 μm, more preferably 50 to 150 μm, especially 85 to 115 μm
- porosity in the range from 10 to 60%, more preferably 15 to 35%, especially 20 to 30%
- ratio of surface to volume in the range from 3000 to 50 000 $m^2/m^3$, more preferably 5000 to 15 000 $m^2/m^3$.

The individual channels may have, for example, with a rectangular cross section, cross-sectional dimensions of 50 μm×25 μm to 600 μm×300 μm, especially about 200 μm×100 μm. The wall thickness may especially preferably be about 100 μm. The porosity may more preferably be about 25%. The porosity is thus typically significantly lower than the porosity of a packed sphere bed. This allows more magnetocaloric material to be introduced into a given volume of the magnetic field. This leads to a greater thermal effect with equal expenditure to provide the magnetic field.

If the magnetocaloric material is present in form of a shaped body, the shaped body preferably has continuous channels with a cross-sectional area of the individual channels in the range from 0.001 to 0.2 $mm^2$ and a wall thickness of 50 to 300 μm, a porosity in the range from 10 to 60% and a ratio of surface to volume in the range from 3000 to 50 000 $m^2/m^3$.

Alternatively, the magnetocaloric cascades may comprise or be formed from a plurality of parallel sheets of the different magnetocaloric materials with a sheet thickness of 0.1 to 2 mm, preferably 0.5 to 1 mm, and a plate separation (interstice) of 0.01 to 1 mm, preferably 0.05 to 0.2 mm. The number of sheets may, for example, be 5 to 100, preferably 10 to 50.

The shaped body is produced, for example, by extrusion, injection molding or molding of the magnetocaloric material.

The very large ratio of surface to volume allows excellent heat transfer, coupled with a very low pressure drop. The pressure drop is, for instance, one order of magnitude lower than for a packed bed of spheres which has the identical heat transfer coefficient. The monolith form thus allows the coefficient of performance (COP), for example of a magnetocaloric cooling device, to be improved considerably once again.

The beds of the individual materials, or stacks of plates or shaped bodies of the individual materials, are combined to give the inventive magnetocaloric cascade, either by bonding them directly to one another or stacking them one on top of another, or separating them from one another by intermediate thermal and/or electrical insulators.

As mentioned above, the different magnetocaloric materials may be insulated from one another by intermediate thermal and/or electrical insulators. The thermal and/or electrical insulators may be selected from any suitable materials. Suitable materials combine a low thermal conductivity with a low electrical conductivity and prevent the occurrence of eddy currents, the cross-contamination of the different magnetocaloric materials by constituents of the adjacent magnetocaloric materials, and heat losses owing to thermal conduction from the hot side to the cold side. The insulators are preferably thermal insulators, especially simultaneously thermal and electrical insulators. They preferably combine a high mechanical strength with good electrical and thermal insulating action. High mechanical strength allows reduction or absorption of the mechanical stresses in the bed, which result from the cycle of introduction into and removal from the magnetic field. In the course of introduction into the magnetic field and removal from the magnetic field, the forces acting on the magnetocaloric material may be considerable owing to the strong magnets. Examples of suitable materials are engineering plastics such as PEEK, PSU, PES, liquid-crystalline polymers and multilayer composite materials, carbon fibers and meshes, ceramics, inorganic oxides, glasses, semiconductors and combinations thereof.

The insulators are more preferably formed from carbon fibers.

If adjacent magnetocaloric materials are insulated from one another by intermediate thermal and/or electrical insulators the intermediate space between the magnetocaloric materials is preferably filled by the thermal and/or electrical insulators to an extent of at least 90%, preferably completely.

It is preferred according to the invention when the different magnetocaloric materials with different Curie temperatures form a layer structure, wherein the different layers of different magnetocaloric materials may be insulated from one another by intermediate thermal and/or electrical insulators. According to one embodiment of the inventive magnetocaloric cascade the magnetocaloric materials, and if present the thermal and/or electrical insulators form a layer sequence, the layer thickness of each of the magnetocaloric materials being 0.1 to 100 mm.

In one embodiment of the invention, the thermal and/or electrical insulators form a matrix into which the magnetocaloric materials are embedded. This means that each of the magnetocaloric materials and also the cascade of the magnetocaloric materials overall are completely surrounded by the insulator material. The thickness of the insulator material surrounding the magnetocaloric cascade (layer thickness) is preferably 0.5 to 10 mm, more preferably 1 to 5 mm.

The different magnetocaloric materials with different Curie temperatures contained in the inventive magnetocaloric cascades may be selected from any suitable magnetocaloric materials.

In the meantime a wide variety of possible magnetocaloric materials and their preparation are known to the person skilled in the art.

The inventive magnetocaloric cascades may be prepared by a process, which comprises subjecting powders of the particular the magnetocaloric materials to shaping to form the magnetocaloric materials and subsequently packing the magnetocaloric materials to form the magnetocaloric cascade.

Preferred magnetocaloric materials are selected from (1) compounds of the general formula (I)

$$(A_yB_{1-y})_{2+d}C_wD_xE_z \quad \text{(I)}$$

where

A: is Mn or Co,

B: is Fe, Cr or Ni,

C, D and E: at least two of C, D and E are different, have a non-vanishing concentration and are selected from P, B, Se, Ge, Ga, Si, Sn, N, As and Sb, where at least one of C, D and E is Ge, As or Si, d: is a number in the range from −0.1 to 0.1, w, x, y, z: are numbers in the range from 0 to 1, where w+x+z=1;

(2) La- and Fe-based compounds of the general formulae (II) and/or (III) and/or (IV)

$$La(Fe_xAl_{1-x})_{13}H_y \text{ or } La(Fe_xSi_{1-x})_{13}H_y \quad \text{(II)}$$

where x: is a number from 0.7 to 0.95, y: is a number from 0 to 3, preferably from 0 to 2;

$$La(Fe_xAl_yCo_z)_{13} \text{ or } La(Fe_xSi_yCo_z)_{13} \quad \text{(III)}$$

where x: is a number from 0.7 to 0.95, y: is a number from 0.05 to 1−x, z: is a number from 0.005 to 0.5; and $$LaMn_xFe_{2-x}Ge \quad \text{(IV)}$$

where x: is a number from 1.7 to 1.95;

(3) Heusler alloys of the $MnT_tT_p$ type where $T_t$ is a transition metal and $T_p$ is a p-doping metal having an electron count per atom e/a in the range from 7 to 8.5;

(4) Gd- and Si-based compounds of the general formula (V)

$$Gd_5(Si_xGe_{1-x})_4 \quad \text{(V)}$$

where x is a number from 0.2 to 1;

(5) $Fe_2P$-based compounds;

(6) manganites of the perovskite type;

(7) compounds which comprise rare earth elements and are of the general formulae (VI) and (VII)

$$Tb_5(Si_{4-x}Ge_x) \quad \text{(VI)}$$

where x: is 0, 1, 2, 3, 4;

$$XTiGe \quad \text{(VII)}$$

where X: is Dy, Ho, Tm; and (8) Mn- and Sb- or As-based compounds of the general formulae (VIII), (IX), (X), and (XI)

$$Mn_{2-x}Z_xSb \quad \text{(VIII)}$$

$$Mn_2Z_xSb_{1-x} \quad \text{(IX)}$$

where

Z: is Cr, Cu, Zn, Co, V, As, Ge, x: is from 0.01 to 0.5, $$Mn_{2-x}Z_xAs \quad \text{(X) and}$$

$$Mn_2Z_xAs_{1-x} \quad \text{(XI)}$$

where

Z: is Cr, Cu, Zn, Co, V, Sb, Ge, x: is from 0.01 to 0.5.

It has been found in accordance with the invention that the aforementioned magnetocaloric materials can be used advantageously in the inventive magnetocaloric cascades.

Particular preference is given in accordance with the invention to the metal-based materials selected from compounds (1), (2) and (3), and also (5), especially preferred are compounds (I).

Materials particularly suitable in accordance with the invention are described, for example, in WO 2004/068512 A1, Rare Metals, Vol. 25, 2006, pages 544 to 549, J. Appl. Phys. 99,08Q107 (2006), Nature, Vol. 415, Jan. 10, 2002, pages 150 to 152 and Physica B 327 (2003), pages 431 to 437.

Magnetocaloric materials of general formula (I) are described in WO 2004/068512 A1 and WO 2003/012801 A1. Preference is given to magnetocaloric materials selected from at least quaternary compounds of the general formula (I) wherein C, D and E are preferably identical or different and are selected from at least one of P, As, Ge, Si, Sn and Ga. More preferred are magnetocaloric materials selected from at least quaternary compounds of the general formula (I) which, as well as Mn, Fe, P and optionally Sb, additionally comprise Ge or Si or As or both Ge and Si or both Ge and As or both Si and As, or each of Ge, Si and As. The material preferably has the general formula $MnFe(P_wGe_xSi_z)$ wherein x is preferably a number in the range from 0.3 to 0.7, w is less than or equal to 1−x and z corresponds to 1−x−w. The material preferably has the crystalline hexagonal $Fe_2P$ structure. Examples of suitable materials are $MnFeP_{0.45\ to\ 0.7}$, $Ge_{0.55\ to\ 0.30}$ and $MnFeP_{0.5\ to\ 0.70}$, $(Si/Ge)_{0.5\ to\ 0.30}$. (Si/Ge) means that [both are present, one is present or both possibilities are included? If so,]

Also preferred at least 90% by weight, more preferably at least 95% by weight, of component A is Mn. More preferably at least 90% by weight, more preferably at least 95% by weight, of B is Fe. Preferably at least 90% by weight, more preferably at least 95% by weight, of C is P. Preferably at least 90% by weight, more preferably at least 95% by weight, of D is Ge. Preferably at least 90% by weight, more preferably at least 95% by weight, of E is Si.

Suitable compounds are additionally $Mn_{1+x}Fe_{1-x}P_{1-y}Ge_y$ with x in the range from −0.3 to 0.5, y in the range from 0.1 to 0.6. Likewise suitable are compounds of the general formula $Mn_{1+x}Fe_{1-x}P_{1-y}Ge_{y-z}Sb_z$ with x in the range from −0.3 to 0.5, y in the range from 0.1 to 0.6 and z less than y and less than 0.2. Also suitable are compounds of the formula $Mn_{1+x}Fe_{1-x}P_{1-y}Ge_{y-z}Si_z$ with x in the range from 0.3 to 0.5, y in the range from 0.1 to 0.66, z less than or equal to y and less than 0.6.

Especially useful magnetocaloric materials of general formula (I) exhibiting a small thermal hysteris of the magnetic phase transition are described in WO 2011/111004 and WO 2011/083446 having the general formula $$(Mn_xFe_{1-x})_{2+z}P_{1-y}Si_y$$

where $0.20 \leq x \leq 0.40$ $0.4 \leq y \leq 0.8$ $-0.1 \leq z \leq 0.1$ or $0.55 \leq x < 1$ $0.4 \leq y \leq 0.8$ $-0.1 \leq z \leq 0.1$.

Suitable $Fe_2P$-based compounds originate from $Fe_2P$ and $FeAs_2$, and obtain optionally Mn and P. They correspond, for example, to the general formulae $MnFe_{1-x}Co_xGe_x$ where x=0.7-0.9, $Mn_{5-x}Fe_xSi_3$ where x=0-5, $Mn_5Ge_{3-x}Sb_x$ where x=0.1-2, $Mn_5Ge_{3-x}Sb_x$ where x=0-0.3, $Mn_{2-x}Fe_xGe_2$ where x=0.1-0.2, $Mn_{3-x}Co_xGaC$ where x=0-0.05. A description of magnetocaloric $Fe_2P$-based compounds may be found in E. Brueck et al., J. Alloys and Compounds 282 (2004), pages 32 to 36.

Preferred La- and Fe-based compounds of the general formulae (II) and/or (III) and/or (IV) are $La(Fe_{0.90}Si_{0.10})_{13}$, $La(Fe_{0.89}Si_{0.11})_{13}$, $La(Fe_{0.880}Si_{0.120})_{13}$, $La(Fe_{0.877}Si_{0.123})_{13}$, $LaFe_{11.8}Si_{1.2}$, $La(Fe_{0.88}Si_{0.12})_{13}H_{0.5}$, $La(Fe_{0.88}Si_{0.12})_{13}H_{1.0}$, $LaFe_{11.7}Si_{1.3}H_{1.1}$, $LaFe_{11.57}Si_{1.43}H_{1.3}$, $La(Fe_{0.88}Si_{0.12})H_{1.5}$, $LaFe_{11.2}Co_{0.7}Si_{1.1}$, $LaFe_{11.5}Al_{1.5}C_{0.1}$, $LaFe_{11.5}Al_{1.5}C_{0.2}$, $LaFe_{11.5}Al_{1.5}C_{0.4}$, $LaFe_5Al_{1.5}Co_{0.5}$, $La(Fe_{0.94}Co_{0.06})_{11.83}Al_{1.17}$, $La(Fe_{0.92}Co_{0.08})_{11.83}Al_{1.17}$.

Suitable manganese-comprising compounds are MnFeGe, $MnFe_{0.9}Co_{0.1}Ge$, $MnFe_{0.8}Co_{0.2}Ge$, $MnFe_{0.7}Co_{0.3}Ge$, $MnFe_{0.6}Co_{0.4}Ge$, $MnFe_{0.5}Co_{0.5}Ge$, $MnFe_{0.4}Co_{0.6}Ge$, $MnFe_{0.3}Co_{0.7}Ge$, $MnFe_{0.2}Co_{0.8}Ge$, $MnFe_{0.15}Co_{0.85}Ge$, $MnFe_{0.1}Co_{0.9}Ge$, MnCoGe, $Mn_5Ge_{2.5}Si_{0.5}$, $Mn_5Ge_2Si$, $Mn_5Ge_{1.5}Si_{1.5}$, $Mn_5GeSi_2$, $Mn_5Ge_3$, $Mn_5Ge_{2.9}Sb_{0.1}$, $Mn_5Ge_{2.8}Sb_{0.2}$, $Mn_5Ge_{2.7}Sb_{0.3}$, $LaMn_{1.9}Fe_{0.1}Ge$, $LaMn_{1.85}Fe_{0.15}Ge$, $LaMn_{1.8}Fe_{0.2}Ge$, $(Fe_{0.9}Mn_{0.1})_3C$, $(Fe_{0.8}Mn_{0.2})_3C$, $(Fe_{0.7}Mn_{0.3})_3C$, $Mn_3GaC$, MnAs, (Mn, Fe)As, $Mn_{1+\delta}As_{0.8}Sb_{0.2}$, $MnAs_{0.75}Sb_{0.25}$, $Mn_{1.1}As_{0.75}Sb_{0.25}$, $Mn_{1.5}As_{0.75}Sb_{0.25}$.

Heusler alloys suitable in accordance with the invention are, for example, $Ni_2MnGa$, $Fe_2MnSi_{1-x}Ge_x$ with x=0-1 such as $Fe_2MnSi_{0.5}Ge_{0.5}$, $Ni_{52.9}Mn_{22.4}Ga_{24.7}$, $Ni_{50.9}Mn_{24.7}Ga_{24.4}$, $Ni_{55.2}Mn_{18.6}Ga_{26.2}$, $Ni_{51.6}Mn_{24.7}Ga_{23.8}$, $Ni_{52.7}Mn_{23.9}Ga_{23.4}$, CoMnSb, $CoNb_{0.2}Mn_{0.8}Sb$, $CoNb_{0.4}Mn_{0.6}SB$, $CoNb_{0.6}Mn_{0.4}Sb$, $Ni_{50}Mn_{35}Sn_{15}$, $Ni_{50}Mn_{37}Sn_{13}$, $MnFeP_{0.45}As_{0.55}$, $MnFeP_{0.47}As_{0.53}$, $Mn_{1.1}Fe_{0.9}P_{0.47}As_{0.53}$, $MnFeP_{0.89-X}Si_XGe_{0.11}$, X=0.22, X=0.26, X=0.30, X=0.33.

Additionally suitable are $Fe_{90}Zr_{10}$, $Fe_{82}Mn_8Zr_{10}$, $Co_{66}Nb_9Co_1Si_{12}B_{12}$, $Pd_{40}Ni_{22.5}Fe_{17.5}P_{20}$, FeMo—SiB-CuNb, $Gd_{70}Fe_{30}$, GdNiAl, $NdFe_{12}B_6GdMn_2$.

Manganites of the perovskite type are, for example, $La_{0.6}Ca_{0.4}MnO_3$, $La_{0.67}Ca_{0.33}MnO_3$, $La_{0.8}Ca_{0.2}MnO_3$, $La_{0.7}Ca_{0.3}MnO_3$, $La_{0.958}Li_{0.025}Ti_{0.1}Mn_{0.903}$, $La_{0.6}Ca_{0.35}Ti_{0.1}Mn_{0.9}O_3$, $La_{0.799}Na_{0.199}MnO_{2.97}$, $La_{0.88}Na_{0.099}Mn_{0.977}O_3$, $La_{0.877}K_{0.096}Mn_{0.974}O_3$, $La_{0.65}Sr_{0.35}Mn_{0.95}Cn_{0.05}O_3$, $La_{0.7}Nd_{0.1}Na_{0.2}MnO_3$, $La_{0.5}Ca_{0.3}Sr_{0.2}MnO_3$.

Heusler alloys of the $MnT_tT_P$ type where $T_t$ is a transition metal and $T_p$ is a p-doping metal having an electron count per atom e/a in the range from 7 to 8.5 are described are described in Krenke et al., Physical review B72, 014412 (2005).

Gd- and Si-based compounds of the general formula (V)

$$Gd_5(Si_xGe_{1-x})_4$$

where x is a number from 0.2 to 1 are, for example, $Gd_5(Si_{0.5}Ge_{0.5})_4$, $Gd_5(Si_{0.425}Ge_{0.575})_4$, $Gd_5(Si_{0.45}Ge_{0.55})_4$, $Gd_5(Si_{0.365}Ge_{0.635})_4$, $Gd_5(Si_{0.3}Ge_{0.7})_4$, $Gd_5(Si_{0.25}Ge_{0.75})_4$.

Compounds comprising rare earth elements are $Tb_5(Si_{4-x}Ge_x)$ with x=0, 1, 2, 3, 4 or XTiGe with X=Dy, Ho, Tm, for example $Tb_5Si_4$, $Tb_5(Si_3Ge)$, $Tb(Si_2Ge_2)$, $Tb_5Ge_4$, DyTiGe, HoTiGe, TmTiGe.

Mn- and Sb- or As-based compounds of the general formulae (VIII) to (XI) preferably have the definitions of z=0.05 to 0.3, Z=Cr, Cu, Ge, Co.

The magnetocaloric materials used in accordance with the invention can be produced in any suitable manner.

The magnetocaloric materials are produced, for example, by solid phase reaction of the starting elements or starting alloys for the material in a ball mill, subsequent pressing, sintering and heat treatment under inert gas atmosphere and subsequent slow cooling to room temperature. Such a process is described, for example, in J. Appl. Phys. 99, 2006, 08Q107.

Processing via melt spinning is also possible. This makes possible a more homogeneous element distribution which leads to an improved magnetocaloric effect; cf. Rare Metals, Vol. 25, October 2006, pages 544 to 549. In the process described there, the starting elements are first induction-melted in an argon gas atmosphere and then sprayed in the molten state through a nozzle onto a rotating copper roller. There follows sintering at 1000° C. and slow cooling to room temperature.

In addition, reference may be made to WO 2004/068512 A1 for the production. However, the materials obtained by these processes frequently exhibit high thermal hysteresis. For example, in compounds of the $Fe_2P$ type substituted by germanium or silicon, large values for thermal hysteresis are observed within a wide range of 10 K or more.

The thermal hysteresis can be reduced significantly and a large magnetocaloric effect can be achieved when the metal-based materials are not cooled slowing to ambient temperature after the sintering and/or heat treatment, but rather are quenched at a high cooling rate. This cooling rate is at least 100 K/s. The cooling rate is preferably from 100 to 10 000 K/s, more preferably from 200 to 1300 K/s. Especially preferred cooling rates are from 300 to 1000 K/s.

The quenching can be achieved by any suitable cooling processes, for example by quenching the solid with water or aqueous liquids, for example cooled water or ice/water mixtures. The solids can, for example, be allowed to fall into ice-cooled water. It is also possible to quench the solids with subcooled gases such as liquid nitrogen. Further processes for quenching are known to those skilled in the art. What is advantageous here is controlled and rapid cooling.

The rest of the production of the magnetocaloric materials is less critical, provided that the last step comprises the quenching of the sintered and/or heat-treated solid at the inventive cooling rate. The process may be applied to the production of any suitable magnetocaloric materials for magnetic cooling, as described above.

A preferred process for preparing the different magnetocaloric materials used in the inventive magnetocaloric cascades comprises (a) reacting the elements and/or alloys which are present in the later magnetocaloric material in a stoichiometry which corresponds to the magnetocaloric material in the solid or liquid phase obtaining a solid or liquid composition, (b) if the composition obtained in step (a) is liquid phase, transferring the liquid composition obtained from step (a) into the solid phase, (c) optionally shaping the solid compositions obtained from step (a) or (b), (d) sintering and/or heat treatment of the solid composition obtained from one of the preceding steps obtaining a heat treated composition, and (e) rapid quenching of the heat treated composition obtained in step (d).

Preference is given to performing the reaction in step (a) by combined heating of the elements and/or alloys in a closed vessel or in an extruder, or by solid phase reaction in a ball mill. Particular preference is given to performing a solid phase reaction, which is effected especially in a ball mill. Such a reaction is known in principle; cf. the documents cited above. Typically, powders of the individual elements or powders of alloys of two or more of the individual elements which are present in the later magnetocaloric material are mixed in pulverulent form in suitable proportions by weight. If necessary, the mixture can additionally be ground in order to obtain a microcrystalline powder mixture. This powder mixture is preferably heated in a ball mill, which leads to further comminution and also good mixing, and to a solid phase reaction in the powder mixture. Alternatively, the individual elements are mixed as a powder in the selected stoichiometry and then melted.

The combined heating in a closed vessel allows the fixing of volatile elements and control of the stoichiometry. Specifically in the case of use of phosphorus, this would evaporate easily in an open system.

The reaction is followed by sintering and/or heat treatment of the solid in step (d), for which one or more intermediate steps can be provided. For example, the solid obtained in step (a) can be subjected to shaping in step (c) before it is sintered and/or heat treated.

It is possible to send the solid obtained from the ball mill in step (a) to a melt-spinning process in step (c). Melt-spinning processes are known per se and are described, for example, in Rare Metals, Vol. 25, October 2006, pages 544 to 549, and also in WO 2004/068512. The high thermal hysteresis obtained in some case has already been mentioned.

In these processes, the composition obtained in step (a) is melted and sprayed onto a rotating cold metal roller. This spraying can be achieved by means of elevated pressure upstream of the spray nozzle or reduced pressure downstream of the spray nozzle. Typically, a rotating copper drum or roller is used, which can additionally be cooled if appropriate. The copper drum preferably rotates at a surface speed of from 10 to 40 m/s, especially from 20 to 30 m/s. On the copper drum, the liquid composition is cooled at a rate of preferably from $10^2$ to $10^7$ K/s, more preferably at a rate of at least $10^4$ K/s, especially with a rate of from 0.5 to 2×106 K/s.

The melt-spinning, like the reaction in step (a) too, can be performed under reduced pressure or under an inert gas atmosphere.

The melt-spinning achieves a high processing rate, since the subsequent sintering and heat treatment can be shortened. Specifically on the industrial scale, the production of the magnetocaloric materials thus becomes significantly more economically viable. Spray-drying also leads to a high processing rate. Particular preference is given to performing melt spinning.

Alternatively, in step (b), spray cooling can be carried out, in which a melt of the composition from step (a) is sprayed into a spray tower. The spray tower may, for example, additionally be cooled. In spray towers, cooling rates in the range from $10^3$ to $10^5$ K/s, especially about $10^4$ K/s, are frequently achieved.

The sintering and/or heat treatment of the compositions obtained from one of steps (a) to (c) is effected in step (d) preferably first at a temperature in the range from 800 to 1400° C. for sintering and then at a temperature in the range from 500 to 750° C. for heat treatment. For example, the sintering can then be effected at a temperature in the range from 500 to 800° C. For shaped bodies/solids, the sintering is more preferably effected at a temperature in the range from 1000 to 1300° C., especially from 1100 to 1300° C. The heat treatment can then be effected, for example, at from 600 to 700° C.

The sintering is performed preferably for a period of from 1 to 50 hours, more preferably from 2 to 20 hours, especially from 5 to 15 hours. The heat treatment is performed preferably for a period in the range from 10 to 100 hours, more preferably from 10 to 60 hours, especially from 30 to 50 hours. The exact periods can be adjusted to the practical requirements according to the materials.

In the case of use of the melt-spinning process, the period for sintering or heat treatment can be shortened significantly, for example to periods of from 5 minutes to 5 hours, preferably from 10 minutes to 1 hour. Compared to the otherwise customary values of 10 hours for sintering and 50 hours for heat treatment, this results in a major time advantage.

The sintering/heat treatment results in partial melting of the particle boundaries, such that the material is compacted further.

The melting and rapid cooling in step (b) or (c) thus allows the duration of step (d) to be reduced considerably. This also allows continuous production of the magnetocaloric materials.

The pressing can be carried out, for example, as cold pressing or as hot pressing. The pressing may be followed by the sintering process already described.

In the sintering process or sintered metal process, the powders of the magnetocaloric material are first converted to the desired shape of the shaped body, and then bonded to one another by sintering, which affords the desired shaped body. The sintering can likewise be carried out as described above.

It is also possible in accordance with the invention to introduce the powder of the magnetocaloric material into a polymeric binder, to subject the resulting thermoplastic molding material to a shaping, to remove the binder and to sinter the resulting green body. It is also possible to coat the powder of the magnetocaloric material with a polymeric binder and to subject it to shaping by pressing, if appropriate with heat treatment.

According to the invention, it is possible to use any suitable organic binders which can be used as binders for magnetocaloric materials. These are especially oligomeric or polymeric systems, but it is also possible to use low molecular weight organic compounds, for example sugars.

The magnetocaloric powder is mixed with one of the suitable organic binders and filled into a mold. This can be done, for example, by casting or injection molding or by extrusion. The polymer is then removed catalytically or thermally and sintered to such an extent that a porous body with monolith structure is formed.

Hot extrusion or metal injection molding (MIM) of the magnetocaloric material is also possible, as is construction from thin sheets which are obtainable by rolling processes. In the case of injection molding, the channels in the monolith have a conical shape, in order to be able to remove the moldings from the mold. In the case of construction from sheets, all channel walls can run in parallel.

The particular processes are controlled so as to result in magnetocaloric cascades which have a suitable combination of high heat transfer, low flow resistance and high magnetocaloric density. The heat transfer rate limits the cycle speed and hence has a great influence on the power density. Preference is given to an optimal ratio of high magnetocaloric density and sufficient porosity, so as to ensure efficient heat removal and efficient heat exchange. In other words, the inventive shaped bodies exhibit a high ratio of surface to volume. By virtue of the high surface area, it is possible to transport large amounts of heat out of the material and to transfer them into a heat transfer medium. The structure should be mechanically stable in order to cope with the mechanical stresses by a fluid cooling medium. In addition, the flow resistance should be sufficiently low as to result in only a low pressure drop through the porous material. The magnetic field volume should preferably be minimized.

The inventive magnetocaloric cascades are preferably used in refrigeration systems like fridges, freezers and wine coolers, climate control units including air condition, and heat pumps. The materials should exhibit a large magnetocaloric effect within a temperature range tween −100° C. and +150° C. In these devices the magnetocaloric material is exposed to a varying external magnetic field. This magnetic field can be generated by permanent magnets or electromagnets. Electromagnets may be conventional electromagnets or superconductive magnets.

The following examples demonstrate the effect of the inventive magnetocaloric cascades.

EXAMPLES

Example 1

Simulations of Magnetocaloric Cascades Containing Same Masses of Different Magnetocaloric Materials Exhibiting Different Magnetocaloric Performance Simulations of magnetocaloric cascades consisting of five different magnetocaloric materials with different Curie temperatures and exhibiting different material quality were calculated. The material quality of a magnetocaloric material is in this case considered to be represented by the magnitude of $dT_{ad,max}$ of the material. The magnetocaloric qualities of the materials are ranked in categories as following: 4: best; 3: medium; 2: worst. Materials in category 4 (best) have $dT_{ad,max}$ approximately 30% greater than those in category 3, which in turn have $dT_{ad,max}$ approximately 30% greater than materials in category 2. The mass of each of the five materials is equal. Calculations were performed with five different arrangements of the 5 different magnetocaloric materials as displayed in Table 1. The left side corresponds to cold side of the magnetocaloric cascade, the right corresponds to hot side, e.g. for the arrangement according to the inventive example 1e the two materials of quality 4 are placed at the hot side of the magnetocaloric cascade.

TABLE 1

| Example | Cold side → Hot side |
|---|---|
| 1a (non inventive): | 4 4 3 3 2 |
| 1b (non inventive): | 3 3 4 3 3 |

TABLE 1-continued

| Example | Cold side → Hot side |
|---|---|
| 1c (non inventive): | 2 2 4 2 2 |
| 1d (inventive): | 4 4 2 4 4 |
| 1e (inventive): | 2 3 3 4 4 |

Figure 2:
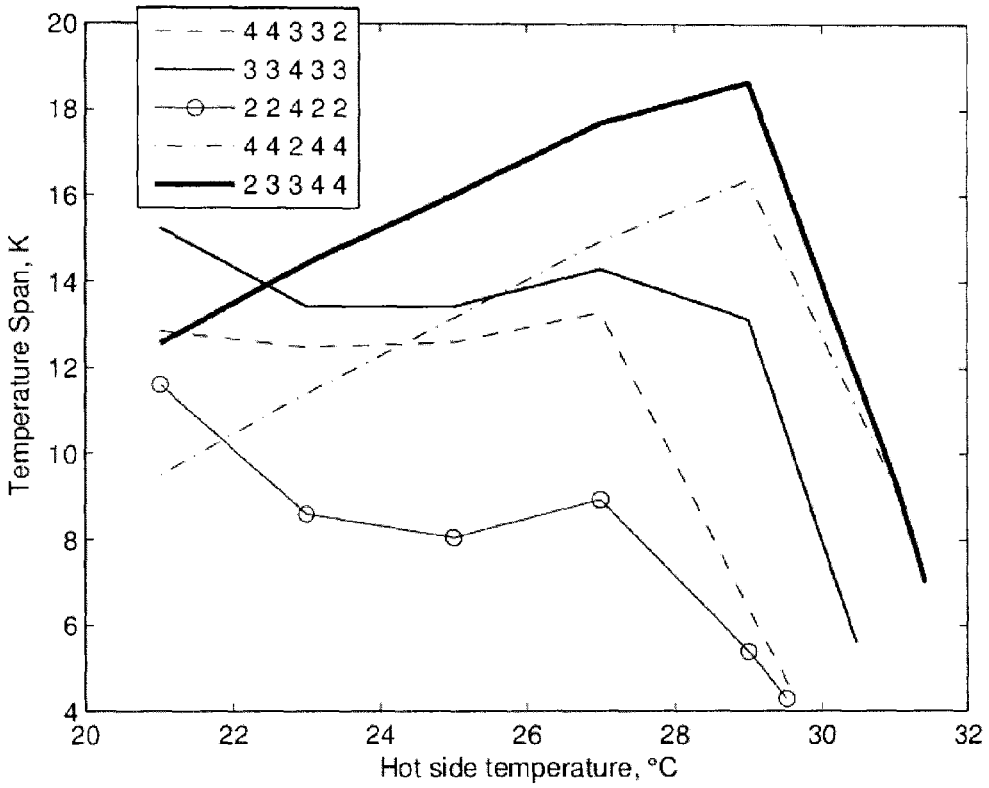
FIG. 2 shows a graph of a temperature span of magnetocaloric cascades consisting of five different magnetocaloric materials at various hot side temperatures.

In the simulations, the Curie temperatures of the 5 different material layers were 279.5K; 283.9K; 287.7K; 293K and 298.2K. The $dT_{ad,max}$ of the materials in category 2, 3 and 4 were 2.2K, 2.9K and 3.6K respectively. The cycle frequency used was 1 Hz and the fluid flow per pumping stage was 4 mL, the material was in the form of granulates of average diameter 0.4 mm. The results of the 5 simulations are shown in FIG. 2, wherein the temperature span achieved is displayed in dependence of the temperature of the hot side. The best temperature span is achieved when the best materials are used at the hot side of the magnetocaloric cascade.

Example 2

Simulations for Magnetocaloric Cascades Containing Same Masses of Different Magnetocaloric Materials of Different Magnetocaloric Quality Simulations were performed with 15 layers of magnetocaloric materials with Curie temperatures evenly spaced from 30° C. to −12° C. The Curie temperature separation between the layers was 3 K. In the simulation, 13 of the magnetocaloric layers had magnetocaloric properties in category 3 (medium) as defined in example 1. Two of the layers of magnetocaloric material had properties in category 4 (best). Simulations were performed where these two layers were positioned (a) at the cold end of the cascade; (b) at the hot end of the cascade and (c) in the middle of the cascade.

Figure 3:
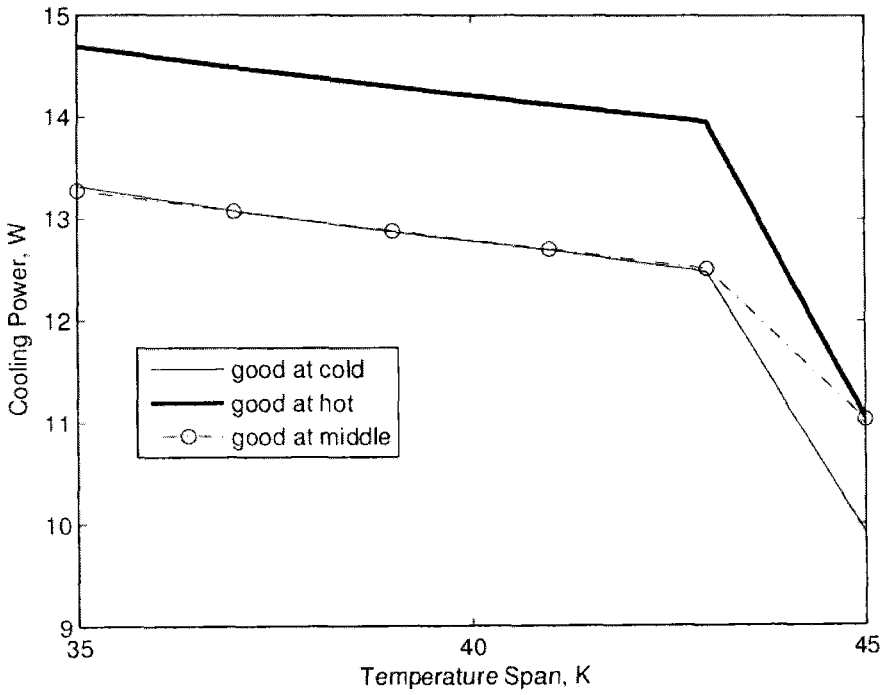
FIG. 3 shows a cooling power of magnetocaloric cascades containing same masses of different magnetocaloric materials of different magnetocaloric quality at various temperature spans.

The simulation results are shown in FIG. 3, wherein the cooling power is displayed in dependence of the temperature span. The magnetocaloric cascade wherein the magnetocaloric material with the highest Curie temperature has the highest magnetocaloric performance shows the best cooling power.

Example 3

Figure 4:
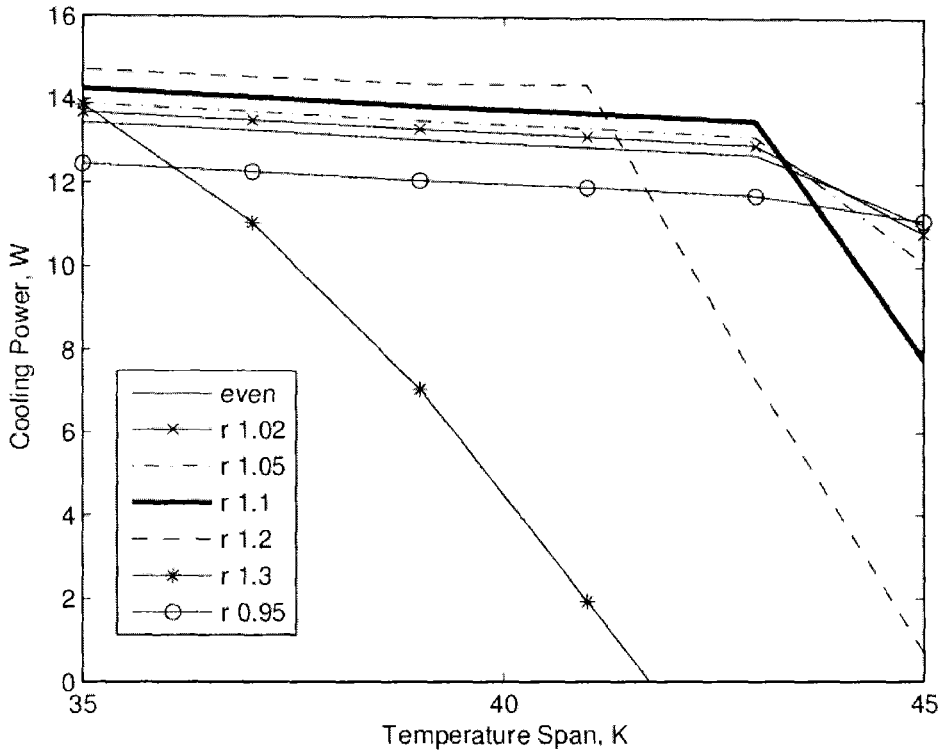
FIG. 4 shows a cooling power of magnetocaloric cascades having different masses of magnetocaloric materials having equal magnetocaloric quality at various temperature spans.

Simulations for Magnetocaloric Cascades Containing Different Masses of Magnetocaloric Materials Having Equal Magnetocaloric Quality Simulations were performed for magnetocaloric cascades containing 15 different magnetocaloric materials with Curie temperatures as in example 2. In this case, all layers exhibit the same magnetocaloric quality. The masses of the layers were weighted by a factor r>1, wherein each layer is r times larger than the previous layer going from the cold side (where the material with the lowest Curie temperature is placed) to the hot side (where the material with the highest Curie temperature is placed), i.e. the material with the highest Curie temperature is present in the largest amount. The cycle properties are the same as those used in example 1. The results are shown in FIG. 4 wherein the cooling power is depicted as a function of temperature span. Higher cooling power can be obtained by weighting the mass of materials of equal magnetocaloric quality towards the hot side of the magnetocaloric cascade.

Example 4

Experimental Magnetocaloric cascades

Two magnetocaloric cascades were built containing 5 different magnetocaloric materials with different Curie temperature. The magnetocaloric materials were all members of the family MnFePAs with varying amounts of the 4 elements as described in WO 2003/012801 A1 yielding different magnetocaloric materials with different Curie temperature. The magnetocaloric materials used exhibit similar magnetocaloric quality, i.e. similar $dT_{ad,max}$. In consequence, different layer performances Lp are caused by the different masses of the respective magnetocaloric materials present in the magnetocaloric cascade.

The magnetocaloric materials were arranged in succession by descending Curie temperature. The total mass of the magnetocaloric materials present in the magnetocaloric cascade was about 60 to 65 g, the magnetocaloric materials were used in the form of irregular particles having an effective diameter of about 300 to 425 microns in a packed bed. In Table 2 the Curie temperatures and masses of the magnetocaloric materials (MCM) used in the cascades are shown. A mixture of 80 vol.-% water and 20 vol.-% glycol was used as heat transfer fluid.

In the experiment, the magnetic field was cycled between 0 and 1.4 T, and the fluid pumped during hot and cold blows was 10.1 mL. The cycle frequency was 1 Hz. The fluid temperature at the hot and cold sides of the cascade was measured, and the temperature span deduced.

TABLE 2

| | Example 4a (non inventive) Curie temperature [K] | Mass [g] | Example 4b (inventive) Curie temperature [K] | Mass [g] |
|---|---|---|---|---|
| MCM 1 | 298.2 | 7.5 | 298.2 | 20 |
| MCM 2 | 293 | 12.5 | 293 | 16.5 |
| MCM 3 | 286.3 | 20 | 287.7 | 13 |
| MCM 4 | 283.9 | 12.5 | 283.9 | 9.5 |
| MCM 5 | 279.5 | 10 | 279.5 | 6 |

Figure 5:
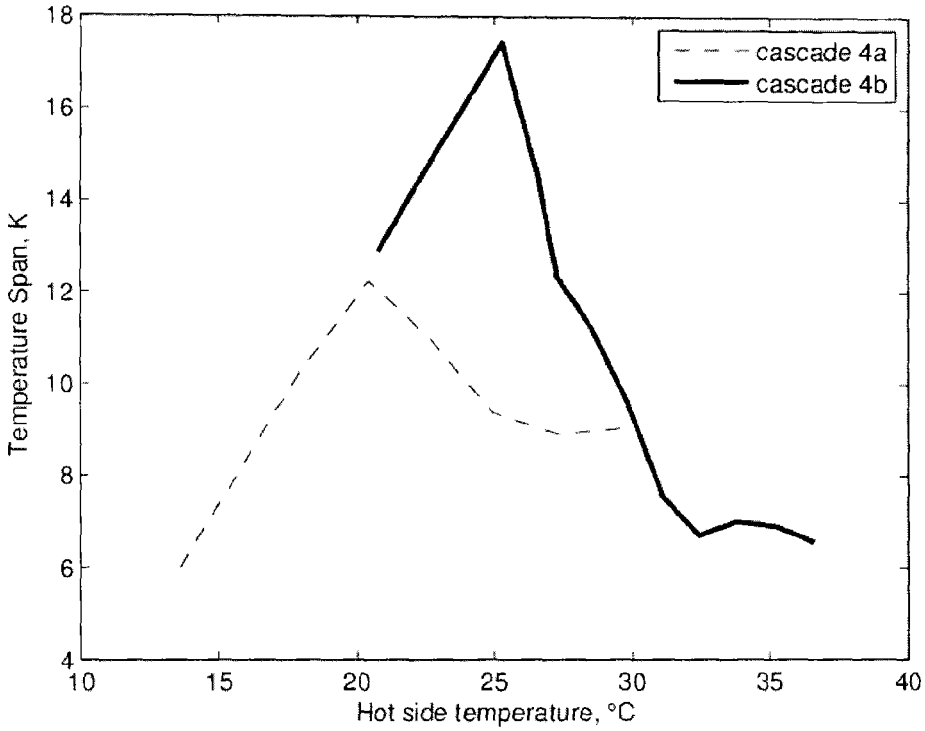
FIG. 5 shows a graph of a temperature span of magnetocaloric cascades 4*a* and 4*b* at various hot side temperature.

The results of the measurements are shown in FIG. 5, wherein the temperature span achieved is depicted in dependence of the temperature at the hot side of the cascade. The inventive magnetocaloric cascade wherein the magnetocaloric material is weighted towards the hot side (high Curie temperature side) of the magnetocaloric cascade showed a higher temperature span than the non-inventive magnetocaloric cascade.

The invention claimed is:

1. A magnetocaloric cascade comprising at least three different magnetocaloric materials having different Curie temperatures, which are arranged in succession by descending Curie temperature, wherein none of the different magnetocaloric materials having different Curie temperatures has a higher layer performance Lp than the magnetocaloric material having the highest Curie temperature; and wherein at least one of the different magnetocaloric materials having different Curie temperatures has a lower layer performance Lp than the magnetocaloric material having the highest Curie temperature;

wherein Lp of a particular magnetocaloric material is calculated according to a formula:

$$Lp=m*dT_{ad,max}$$

where $dT_{ad,max}$ is a maximum adiabatic temperature change that the particular magnetocaloric material undergoes when it is magnetized from a low magnetic field to high magnetic field during magnetocaloric cycling, and m is a mass of the particular magnetocaloric material in the magnetocaloric cascade.

2. The magnetocaloric cascade according to claim 1, wherein none of the different magnetocaloric materials having different Curie temperatures has a lower layer performance Lp than the magnetocaloric material having the lowest Curie temperature.

3. The magnetocaloric cascade according to claim 1, wherein the layer performance Lp of the magnetocaloric material having the highest Curie temperature is 2 to 100% higher than the layer performance Lp of each of the other different magnetocaloric materials having a different Curie temperature.

4. The magnetocaloric cascade according to claim 1, wherein the layer performance Lp of each of the different magnetocaloric materials having different Curie temperatures is equal or higher than the layer performance Lp of its adjacent magnetocaloric material having a lower Curie temperature.

5. The magnetocaloric cascade according to claim 1, wherein the layer performance Lp of each of the magnetocaloric material layer is higher by 2 to 100% than the layer performance Lp of its adjacent magnetocaloric material layer having lower Curie temperature.

6. The magnetocaloric cascade according to claim 1, wherein the mass of each of the different magnetocaloric materials having different Curie temperatures is equal or higher than the mass of the adjacent magnetocaloric material having a lower Curie temperature.

7. The magnetocaloric cascade according to claim 1, wherein a difference in the Curie temperatures between two adjacent different magnetocaloric materials having different Curie temperatures is 0.5 to 6 K.

8. The magnetocaloric cascade according to claim 1, wherein the magnetocaloric cascade comprises 3 to 100 different magnetocaloric materials having different Curie temperatures.

9. The magnetocaloric cascade according to claim 1, wherein adjacent magnetocaloric materials having different Curie temperatures have a separation of 0.01 to 1 mm.

10. The magnetocaloric cascade according to claim 1, wherein the magnetocaloric materials are insulated from one another by intermediate thermal and/or electrical insulators.

11. The magnetocaloric cascade according to claim 1, wherein the magnetocaloric materials form a layer sequence, the layer thickness of each of the magnetocaloric materials being 0.1 to 100 mm.

12. The magnetocaloric cascade according to claim 1, wherein the magnetocaloric materials are selected from (1) compounds of the general formula (I)

$$(A_yB_{1-y})_{2+d}C_wD_xE_z \quad \text{(I)}$$

where

A is Mn or Co,

B is Fe, Cr or Ni, at least two of C, D and E are different, have a non-vanishing concentration and are selected from the group consisting of P, B, Se, Ge, Ga, Si, Sn, N, As and Sb, where at least one of C, D and E is Ge, As or Si, d is a number in the range from −0.1 to 0.1, w, x, y, and z are numbers in the range from 0 to 1, where w+x+z=1;

(2) La- and Fe-based compounds of the general formulae (II) and/or (III) and/or (IV)

$$La(Fe_xAl_{1-x})_{13}H_y \text{ or } La(Fe_xSi_{1-x})_{13}H_y \quad \text{(II)}$$

where x is a number from 0.7 to 0.95, y is a number from 0 to 3;

$$La(Fe_xAl_yCo_z)_{13} \text{ or } La(Fe_xSi_yCo_z)_{13} \quad \text{(III)}$$

where x is a number from 0.7 to 0.95, y is a number from 0.05 to 1−x, z is a number from 0.005 to 0.5;

$$LaMn_xFe_{2-x}Ge \quad \text{(IV)}$$

where x is a number from 1.7 to 1.95;

(3) Heusler alloys of a $MnT_tT_p$ type where $T_t$ is a transition metal and $T_p$ is a p-doping metal having an electron count per atom e/a in the range from 7 to 8.5;

(4) Gd- and Si-based compounds of the general formula (V)

$$Gd_5(Si_xGe_{1-x})_4 \quad \text{(V)}$$

where x is a number from 0.2 to 1;

(5) $Fe_2P$-based compounds;

(6) manganites of a perovskite type;

(7) compounds that comprise rare earth elements and are of the general formulae (VI) and (VII)

$$Tb_5(Si_{4-x}Ge_x) \quad \text{(VI)}$$

where x is 0, 1, 2, 3, 4; and $$XTiGe \quad \text{(VII)}$$

where X is Dy, Ho, Tm; and (8) Mn- and Sb- or As-based compounds of the general formulae (VIII), (IX), (X), and (XI)

$$Mn_{2-x}Z_xSb \quad \text{(VIII) and}$$

$$Mn_2Z_xSb_{1-x} \quad \text{(IX)}$$

where

Z is Cr, Cu, Zn, Co, V, As, Ge, x is from 0.01 to 0.5;

$$Mn_{2-x}Z_xAs \quad \text{(X) and}$$

$$Mn_2Z_xAs_{1-x} \quad \text{(XI)}$$

where

Z is Cr, Cu, Zn, Co, V, Sb, Ge, x is from 0.01 to 0.5.

13. The magnetocaloric cascade according to claim 12, wherein the magnetocaloric material is a quaternary compound of the general formula (I) comprising Mn;

Fe;

P;

at least one element selected from the group consisting of Ge, Si and As;

and optionally Sb.

14. A process for producing the magnetocaloric cascade according to claim 1, which comprises the process comprising:

shaping subjecting powders a powder of each particular magnetocaloric materials to shaping material to form each magnetocaloric material, and subsequently packing the magnetocaloric materials to form the magnetocaloric cascade.

* * * * *